US008147259B1

(12) United States Patent
Lee

(10) Patent No.: US 8,147,259 B1
(45) Date of Patent: Apr. 3, 2012

(54) FIXING DEVICE OF ANTI-THEFT SIGNAL CONNECTOR

(76) Inventor: Chun-te Lee, Taichung (TW)

( * ) Notice: Subject to any disclaimer, the term of this patent is extended or adjusted under 35 U.S.C. 154(b) by 43 days.

(21) Appl. No.: 12/917,567

(22) Filed: Nov. 2, 2010

(51) Int. Cl.
*H01R 13/44* (2006.01)

(52) U.S. Cl. ..... 439/133; 439/304

(58) Field of Classification Search ..... 439/133, 439/304, 306, 307, 620.03
See application file for complete search history.

(56) References Cited

U.S. PATENT DOCUMENTS 3,573,702 A * 4/1971 O'Keefe ..... 338/220
5,011,422 A * 4/1991 Yeh ..... 439/307
5,055,060 A * 10/1991 Down et al. ..... 439/304
6,234,818 B1 * 5/2001 Chun Te ..... 439/304
6,491,546 B1 * 12/2002 Perry ..... 439/620.03
6,511,333 B1 * 1/2003 Lee et al. ..... 439/133
7,452,239 B2 * 11/2008 Montena ..... 439/620.03
8,062,044 B2 * 11/2011 Montena et al. ..... 439/277

* cited by examiner

*Primary Examiner* — Thanh Tam Le
(74) *Attorney, Agent, or Firm* — Ming Chow; Sinorica, LLC

(57) ABSTRACT

The present invention relates to a fixing device of an anti-theft signal connector. The fixing device includes a connection seat, a container and a positioning plug. The connection seat is an axial metallic pipe. The connection seat includes a positioning plate which is located in a rear section of the connection seat and integrally formed with the connection seat. The container is axially disposed in a front section of the connection seat. The container has a receiving trough therein facing the positioning plate. The receiving trough is adapted to receive a resistance and a capacitor which are connected in series. The positioning plug is disposed in the front section of the connection seat, so that the container is positioned between the positioning plate and the positioning plug. Thereby, the positioning plate is integrally formed with the connection seat for the resistance and the capacitor received in the container to be steady fixed between the connection seat and the positioning plug. The resistance and the capacitor won't cause signal loss under static electricity.

5 Claims, 5 Drawing Sheets

FIXING DEVICE OF ANTI-THEFT SIGNAL CONNECTOR

BACKGROUND OF THE INVENTION

1. Field of the Invention

The present invention relates to a fixing device of an anti-theft signal connector.

2. Description of the Prior Art

FIG. 1 is an exploded view of a conventional signal connector. FIG. 2 is a cross-sectional view of the conventional signal connector. The conventional signal connector 10 comprises a protection sleeve 11, an inner connector 12 and an inner pipe 13. The protection sleeve 11 is a metallic pipe and has a chamber 111 therein. The protection sleeve 11 has an open end formed with an opening 112 which has a smaller diameter. The protection sleeve 11 comprises a bolt 113 extending outward from the opening 112. The inner connector 12 is a metallic pipe and disposed in the protection sleeve 11. The inner connector 12 has a threaded hole 121 inside. A partition 122 is provided at the bottom of the threaded hole 121. The partition 122 has a central hole 123. The inner pipe 13 is made of an insulation material. The inner pipe 13 has a trough 131 therein to receive a capacitor 132 and a resistance 133 which are connected in series. One side of the inner pipe 13 has a central through hole 134 for insertion of the conductive wire of the capacitor 132. Another side of the inner pipe 13 has an opening 135. The opening 135 is tightly covered with a metallic lid 136. The lid 136 has a central hole 137 for insertion of the conductive wire of the resistance 133. The conductive wire of the resistance 133 is welded outside of the central hole 137. Although the conventional signal connector 10 can eliminate static electricity, the inner pipe 13 and the lid 136 must be coupled, respectively. The conventional signal connector easily causes characteristic impedance change at the two joints or generates impedance change because of moisture entering from the joints to result in interference. Accordingly, the inventor of the present invention has devoted himself based on his many years of practical experiences to solve this problem.

SUMMARY OF THE INVENTION

According to the present invention, there is provided a fixing device of an anti-theft signal connector. The fixing device is disposed in the anti-theft signal connector. The fixing device is electrically connected with a resistance and a capacitor. One end of the resistance is electrically connected with one end of the capacitor. Another end of the resistance has a first conductive wire which is axially extended outward. Another end of the capacitor has a second conductive wire which is axially extended outward. The first conductive wire is electrically connected with the fixing device. The fixing device comprises a connection seat, a container and a positioning plug.

The connection seat is disposed in the anti-theft signal connector. The connection seat is an axial metallic pipe. The connection seat comprises a positioning plate which is located in a rear section of the connection seat and integrally formed with the connection seat. An inner side of the positioning plate has a central conical hole. An outer side of the positioning plate has a central protrusion. The protrusion has a round hole which communicates with the conical hole and has a diameter smaller than that of the conical hole.

The container is made of an insulation material and axially disposed in a front section of the connection seat. The container has a receiving trough therein facing the positioning plate. The receiving trough of the container has a bottom formed with a central through hole. The resistance and the capacitor are received in the receiving trough. The first conductive wire is extended out of the round hole and welded to the protrusion. The second conductive wire is extended out of the through hole.

The positioning plug is disposed in the front section of the connection seat, so that the container is positioned between the positioning plate and the positioning plug. The second conductive wire is inserted through the positioning plug.

Thereby, the positioning plate is integrally formed with the connection seat for the resistance and the capacitor received in the container to be steady fixed between the connection seat and the positioning plug. The resistance and the capacitor and the connection seat generate stable impedance match, without signal loss under static electricity.

DETAILED DESCRIPTION OF THE PREFERRED EMBODIMENTS

Embodiments of the present invention will now be described, by way of example only, with reference to the accompanying drawings.

Figure 1:
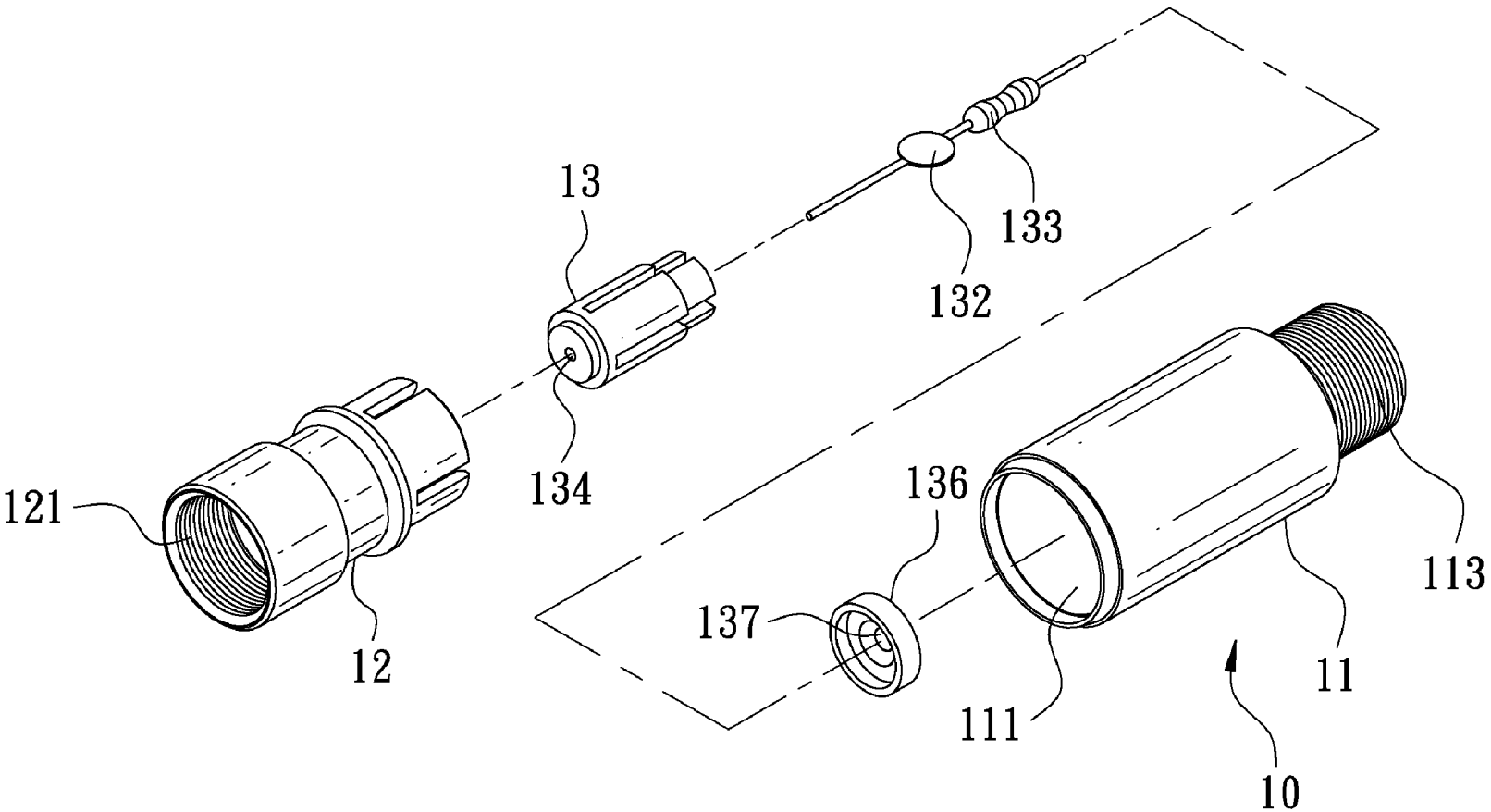
FIG. 1 PRIOR ART
FIG. 1 is an exploded view of a conventional signal connector.
Figure 2:
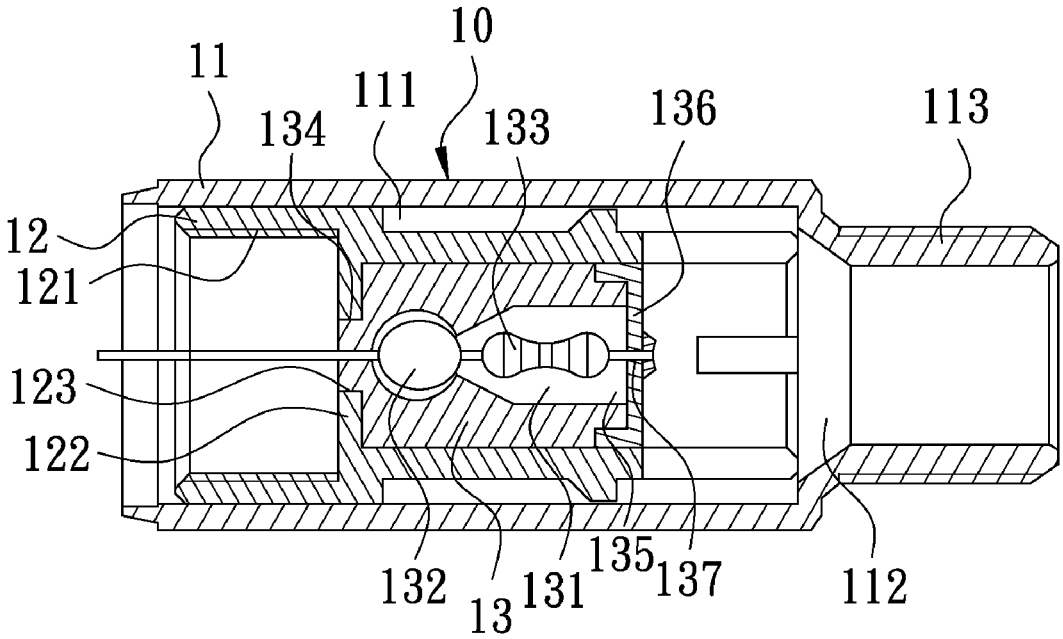
FIG. 2 PRIOR ART
FIG. 2 is a cross-sectional view of the conventional signal connector.
Figure 3:
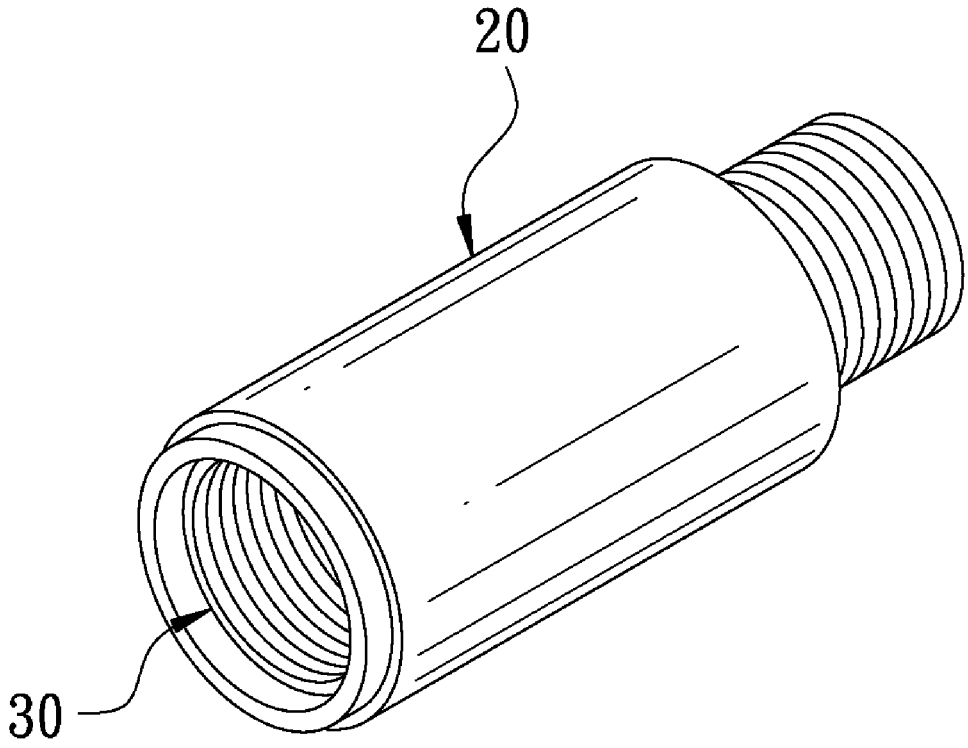
FIG. 3 is a perspective view according to the preferred embodiment of the present invention.

FIG. 3 is a perspective view according to a preferred embodiment of the present invention. The present invention is disposed in an anti-theft signal connector 20. The anti-theft signal connector 20 is an axial metallic pipe and has a chamber 21 which is axially defined in the anti-theft signal connector 20. The anti-theft signal connector 20 comprises a bolt 22 which is axially extended outward from an open end of the chamber 21 for misguiding connection. The bolt 22 doesn't provide any substantial function. The chamber 21 is used to accommodate other components. The anti-theft connection 20 has an opening which is located opposite to the bolt 22 and is riveted to be closed.

Figure 4:
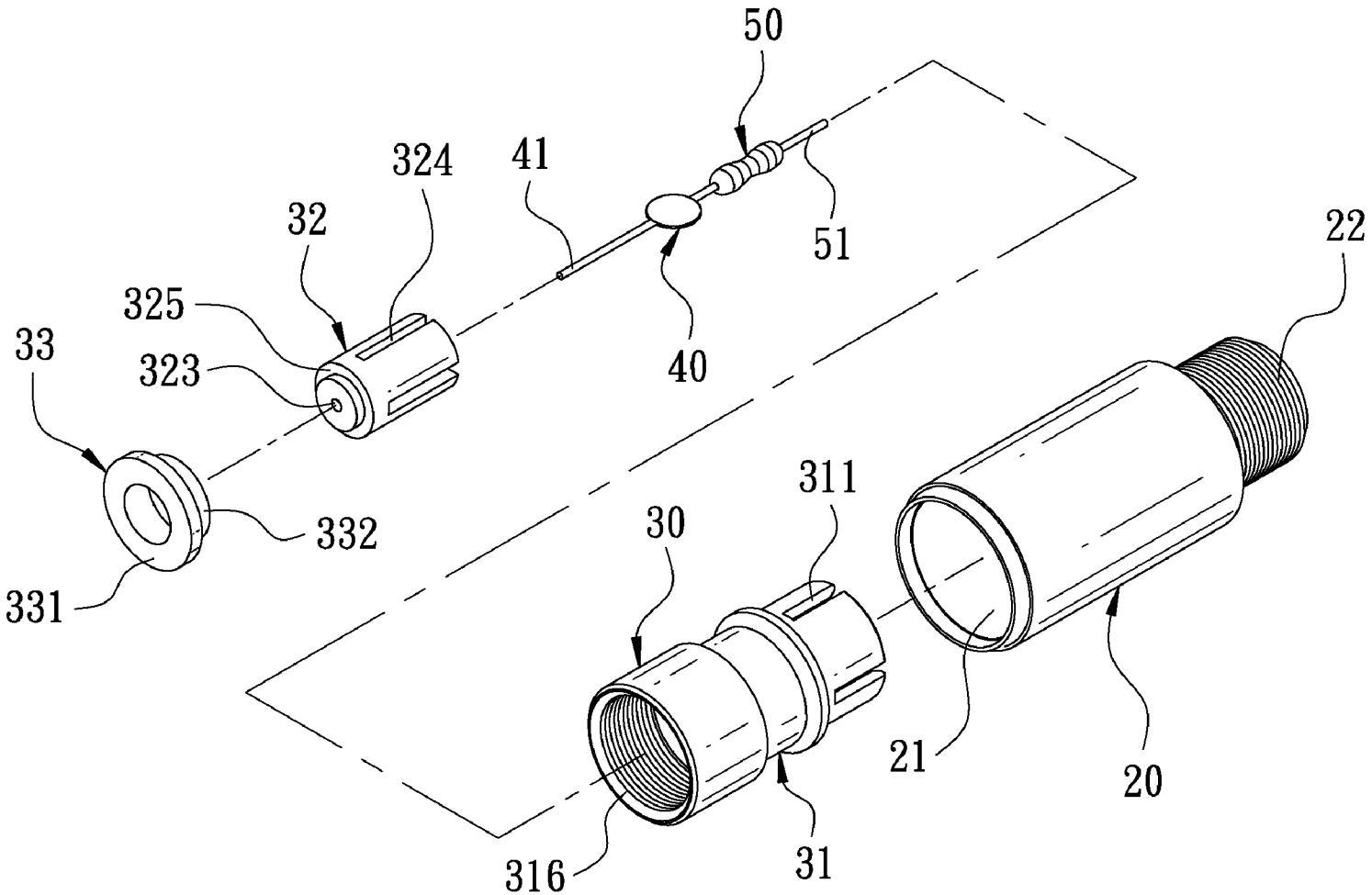
FIG. 4 is an exploded view according to the preferred embodiment of the present invention.
Figure 5:
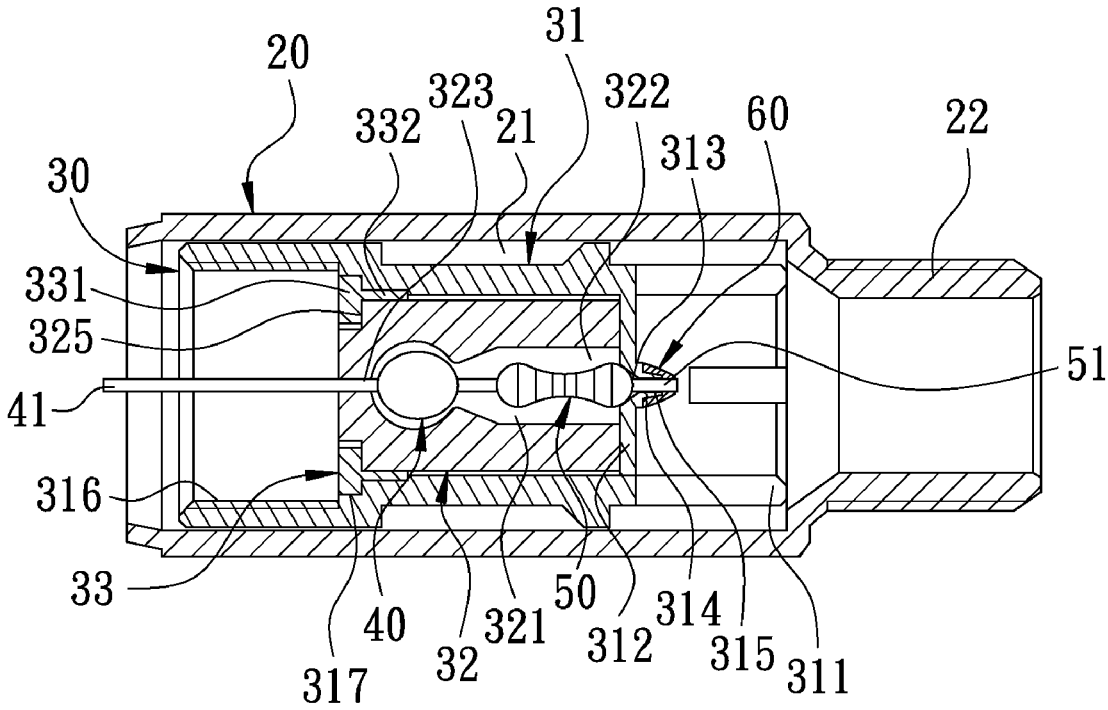
FIG. 5 is a cross-sectional view according to the preferred embodiment of the present invention.

FIG. 4 is an exploded view according to the preferred embodiment of the present invention. FIG. 5 is a cross-sectional view according to the preferred embodiment of the present invention. The fixing device 30 of the present invention comprises a connection seat 31, a container 32 and a positioning plug 33.

The connection seat 31 is disposed in the anti-theft signal connector 20. The connection seat 31 is an axial metallic pipe. The connection seat 31 has a plurality of spaced grooves 311 at a rear section thereof. The grooves 311 are used to engage with a wrench. The connection seat 31 comprises a positioning plate 312 which is located in the rear section of the connection seat 31 and integrally formed with the connection seat 31. An inner side of the positioning plate 312 has a central conical hole 313. An outer side of the positioning plate 312 has a central protrusion 314. The protrusion 314 has a round hole 315 which communicates with the conical hole 313 and has a diameter smaller than that of the conical hole 313. The connection seat 31 has inner threads 316 close to an opening at a front section thereof. The connection seat 31 has a stepped annular groove 317 therein. The stepped annular groove 317 is located between the inner threads 316 and the positioning plate 312.

The container 32 is placed in the connection seat 31 from the opening of the connection seat 31 and is axially disposed in the front section of the connection seat 31. The container 32 is made of an insulation plastic material. The container 32 has a receiving trough 321 therein and an opening 322 at one side thereof facing the positioning plate 312. The container 32 has the side with the opening 322 to hold against the inner side of the positioning plate 312. A capacitor 40 and a resistance 50 are provided in the receiving trough 321. The receiving trough 321 of the container 32 has a bottom formed with a central through hole 323. The capacitor 40 has a conductive wire 41 and the resistance 50 has a conductive 51. The conductive wire 41 is extended out of the through hole 323, and the conductive wire 51 is extended out of the conical hole 313. In this embodiment, the container 32 has a plurality of grooves 324 which are axially spaced on an outer wall of the container 32 at the side having the opening 322, so that the container 32 has a certain elasticity to prop up the container 32 for receiving the capacitor 40 and the resistance 50. The capacitor 40 is located in the bottom of the receiving trough 321. One end of the capacitor 41 has the conductive wire 41 extended out of the through hole 323, and the other end of the capacitor 41 is connected with one end of the resistance 50. The other end of the resistance 50 has the conductive wire 51 extended out of the conical hole 313. The conductive wire 51 of the resistance 50 is welded and connected to the protrusion 314 with a soldering tin 60. The container 32 has a shoulder 325 at another side thereof opposite to the positioning plate 312.

The positioning plug 33 is disposed in the front section of the connection seat 31 to position the container 32 which is disposed between the positioning plate 312 and the positioning plug 33. The positioning plug 33 has a positioning portion 331 and a forcing portion 332. The positioning portion 331 is a hollow annular body, and the forcing portion 332 is axially extended from one side of the positioning portion 331. The positioning portion 331 is loosely fixed to the stepped annular groove 317 and engages with the container 32. The forcing portion 332 is tightly confined between the stepped annular groove 317 and the outer wall of the container 32.

Referring to FIG. 5, to assemble the signal connector of the present invention, the capacitor 40 and the resistance 50 are first connected in series and then inserted in the receiving trough 321 of the container 32 with the conductive wire 41 of the capacitor 40 extending out of the through hole 323. After that, the container 32 is tightly secured in the connection seat 31 with one end against the inner side of the positioning plate 312. The conductive wire 51 of the resistance 50 inserts through the conical hole 313 and the round hole 315, and the conductive wire 51 and the positioning plate 312 are welded with the soldering tin 60. The connection seat 31 coupled with the container 32 is inserted in the chamber 21 of the anti-theft signal connector 20, and then the positioning plug 33 is tightly engaged with the stepped annular groove 317 and the shoulder 325 to complete the assembly of the present invention. The positioning plate 312 is integrally formed with the connection seat 31, so the resistance 50 and the capacitor 40 received in the container 32 are steady fixed between the connection seat 31 and the positioning plug 33, preventing impedance match change because of penetration of moisture and without signal loss under static electricity. When the signal connector of the present invention is in use, the metallic connection seat 31 will generate a grounding effect. The anti-theft signal connector 20 is circular without a pull portion. It is required to use a specific tool to disassemble the anti-theft connector 20. Thus, the present invention provides an anti-theft effect.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A fixing device of an anti-theft signal connector, the fixing device being disposed in the anti-theft signal connector, the fixing device being electrically connected with a resistance and a capacitor, one end of the resistance being electrically connected with one end of the capacitor, another end of the resistance having a first conductive wire which is axially extended outward, another end of the capacitor having a second conductive wire which is axially extended outward, the first conductive wire being electrically connected with the fixing device, the fixing device comprising:

a connection seat disposed in the anti-theft signal connector, the connection seat being an axial metallic pipe, the connection seat comprising a positioning plate which is located in a rear section of the connection seat and integrally formed with the connection seat, an inner side of the positioning plate having a central conical hole, an outer side of the positioning plate having a central protrusion, the protrusion having a round hole which communicates with the conical hole and has a diameter smaller than that of the conical hole;

a container made of an insulation material and axially disposed in a front section of the connection seat, the container having a receiving trough therein facing the positioning plate, the receiving trough of the container having a bottom formed with a central through hole, the resistance and the capacitor being received in the receiving trough, the first conductive wire being extended out of the round hole and welded to the protrusion, the second conductive wire being extended out of the through hole; and a positioning plug disposed in the front section of the connection seat, the container being positioned between the positioning plate and the positioning plug, the second conductive wire inserting through the positioning plug;

thereby, the positioning plate being integrally formed with the connection seat for the resistance and the capacitor received in the container to be steady fixed between the connection seat and the positioning plug, the resistance and the capacitor and the connection seat generating stable impedance match, without signal loss under static electricity.

2. The fixing device as claimed in the claim 1, wherein the connection seat has inner threads close to an opening at the front section thereof, the connection seat has a stepped annular groove close to the inner threads, the positioning plug has a positioning portion, and the positioning portion is loosely fixed to the stepped annular groove and engages with the container.

3. The fixing device as claimed in the claim 2, wherein the positioning plug has a forcing portion, the forcing portion is axially extended from one side of the positioning portion, and the forcing portion is tightly confined between the stepped annular groove and an outer wall of the container.

4. The fixing device as claimed in the claim 1, wherein the container has a shoulder at one side thereof opposite to the positioning plate, and the positioning plug has a positioning portion to engage with the shoulder.

5. The fixing device as claimed in the claim 4, wherein the positioning plug has a forcing portion, the forcing portion is axially extended from one side of the positioning portion, and the forcing portion is tightly confined between the stepped annular groove and an outer wall of the container.

* * * * *